US009746172B1

(12) United States Patent
Cheng et al.

(10) Patent No.: US 9,746,172 B1
(45) Date of Patent: Aug. 29, 2017

(54) SOLID STATE DISK

(71) Applicant: ALSON TECHNOLOGY LIMITED, Kowloon OT (HK)

(72) Inventors: Han-Hung Cheng, Zhubei (TW); Chi-Fen Kuo, Zhubei (TW); Wei-Di Cheng, Zhubei (TW)

(73) Assignee: ALSON TECHNOLOGY LIMITED, Kowloon (HK)

( * ) Notice: Subject to any disclaimer, the term of this patent is extended or adjusted under 35 U.S.C. 154(b) by 0 days.

(21) Appl. No.: 15/182,862

(22) Filed: Jun. 15, 2016

(51) Int. Cl.

| | |
|---|---|
| ***F21V 7/22*** | (2006.01) |
| ***F21V 33/00*** | (2006.01) |
| ***F21V 11/08*** | (2006.01) |
| ***F21V 7/00*** | (2006.01) |
| *F21Y 113/00* | (2016.01) |

(52) U.S. Cl.
CPC ..... *F21V 33/00* (2013.01); *F21V 7/0008* (2013.01); *F21V 7/22* (2013.01); *F21V 11/08* (2013.01); *F21Y 2113/002* (2013.01)

(58) Field of Classification Search
CPC ..... G06F 1/181; G09F 13/00; G09F 13/04; G09F 13/22; G09F 23/00; F21V 23/0442; F21V 23/005; F21V 23/003; F21V 33/00; F21V 1/08; F21V 7/0008; F21V 7/22
See application file for complete search history.

(56) References Cited

U.S. PATENT DOCUMENTS

2014/0006603 A1* 1/2014 Yang ..... G06F 11/3034 709/224
2014/0372778 A1* 12/2014 Tian ..... G06F 13/4081 713/322

* cited by examiner

*Primary Examiner* — Thomas M Sember
(74) *Attorney, Agent, or Firm* — Muncy, Geissler, Olds & Lowe, P.C.

(57) ABSTRACT

A solid state disk is provided, including: a main body, including a shell portion, a substrate which is disposed on the shell portion and a memory module which is disposed on the substrate, the substrate including a transmission port, the memory module being electrically connected to the transmission port; at least one light-emitting portion, disposed on the substrate and electrically connected to the transmission port; at least one scattering light-guiding portion, arranged on the substrate correspondingly to the light-emitting portion without covering any part of the at least one light-emitting portion, each said scattering light-guiding portion having a scattering structure, at least one part of light emitted from each said light-emitting portion projecting toward the scattering structure and the light being scattered evenly via the scattering light-guiding portion to an exterior of the solid state disk.

10 Claims, 4 Drawing Sheets

SOLID STATE DISK

BACKGROUND OF THE INVENTION

Field of the Invention

The present invention relates to a solid state disk.

Description of the Prior Art

Conventionally, a solid state disk is provided with a light-emitting device like LED for reminding or decoration.

However, in the conventional solid state disk, a light-guiding device is arranged on the light-emitting device, the light-emitting device is too close to the light-guiding device, and a light source of the light-emitting device projects light to the light-guiding device via a point; therefore, it is hard for the light-guiding device to reach evenness; and it is hard for the light-emitting device to dissipate heat, and the light-emitting device may be damaged. In addition, the light projected from the light-emitting device and the light-guiding device does not create other visual effects.

The present invention has arisen to mitigate and/or obviate the afore-described disadvantages.

SUMMARY OF THE INVENTION

The major object of the present invention is to provide a solid state disk which emits an even light so that at least one light-emitting portion can dissipate heat well, and the at least one light-emitting portion does not need to be disposed on a carrier and fixed on a substrate so as to save the volume and the weight of the solid state disk.

To achieve the above and other objects, a solid state disk is provided, including: a main body, including a shell portion, a substrate which is disposed on the shell portion and a memory module which is disposed on the substrate, the substrate including a transmission port, the memory module being electrically connected to the transmission port; at least one light-emitting portion, disposed on the substrate and electrically connected to the transmission port; at least one scattering light-guiding portion, arranged on the substrate correspondingly to the at least one light-emitting portion without covering any part of the at least one light-emitting portion, each said scattering light-guiding portion having a scattering structure, at least one part of light emitted from each said light-emitting portion projecting toward the scattering structure and being scattered evenly via the scattering light-guiding portion to an exterior of the solid state disk.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
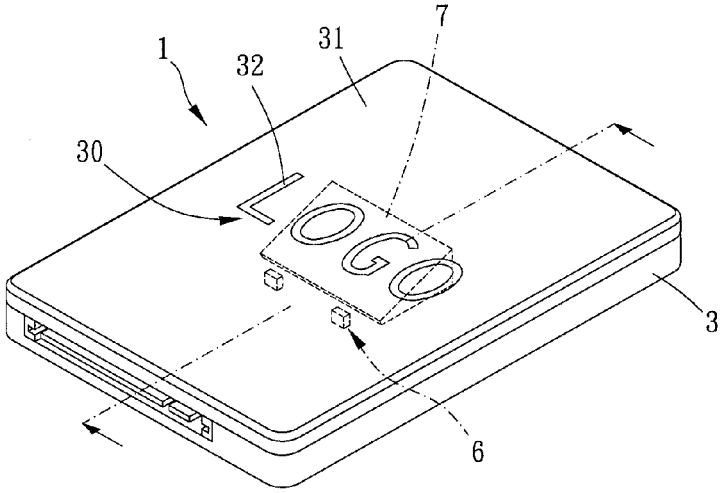
FIG. 1 is a stereogram of a preferred embodiment of the present invention.
Figure 2:
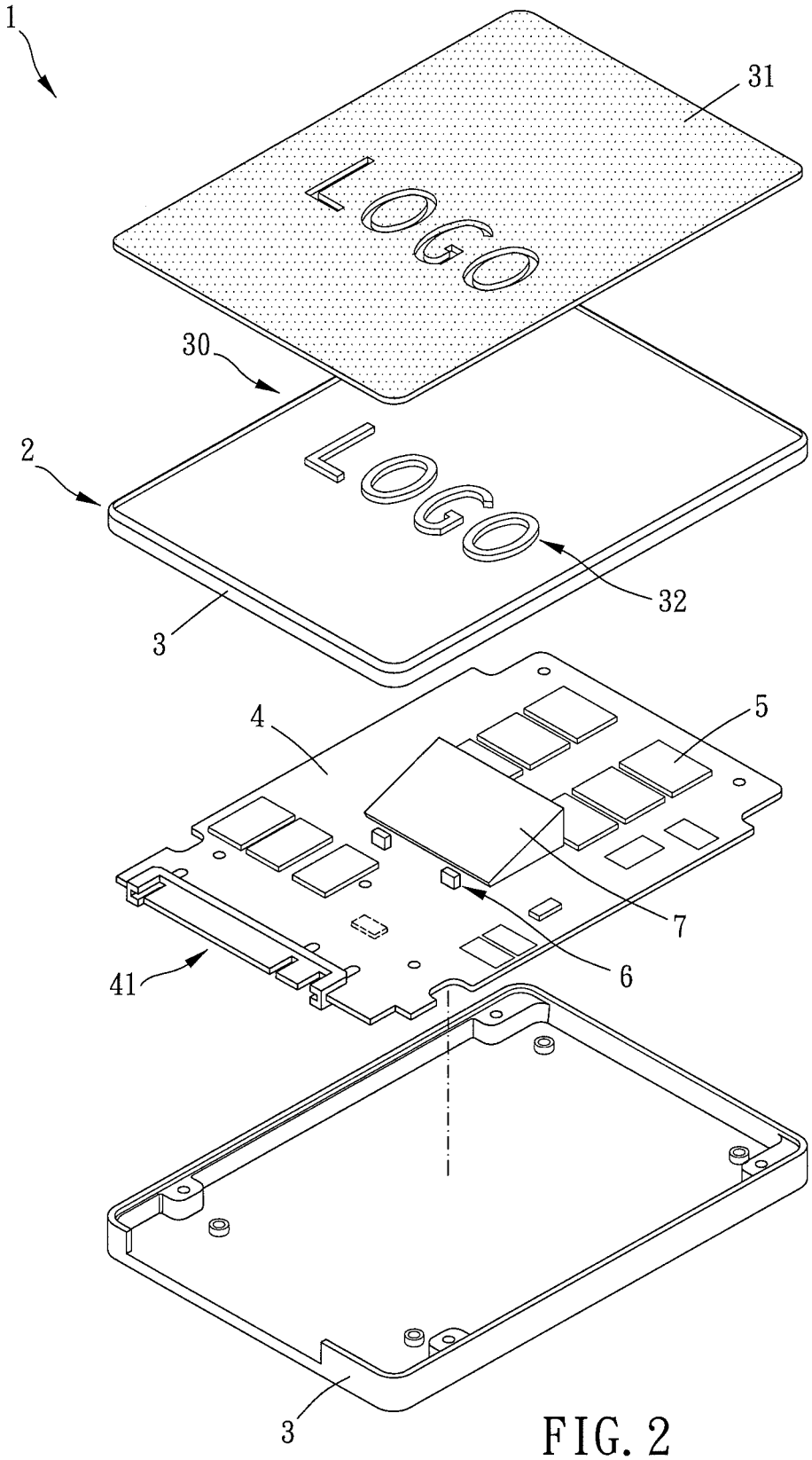
FIG. 2 is a breakdown view of the preferred embodiment of the present invention.
Figure 3:
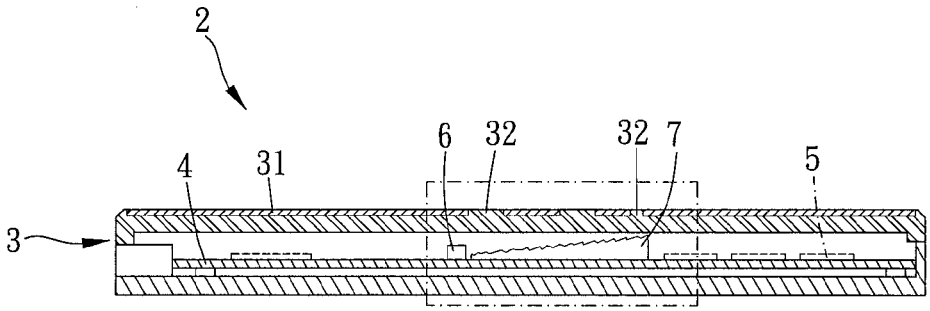
FIG. 3 is a cross-sectional side view of the preferred embodiment of the present invention.
Figure 4:
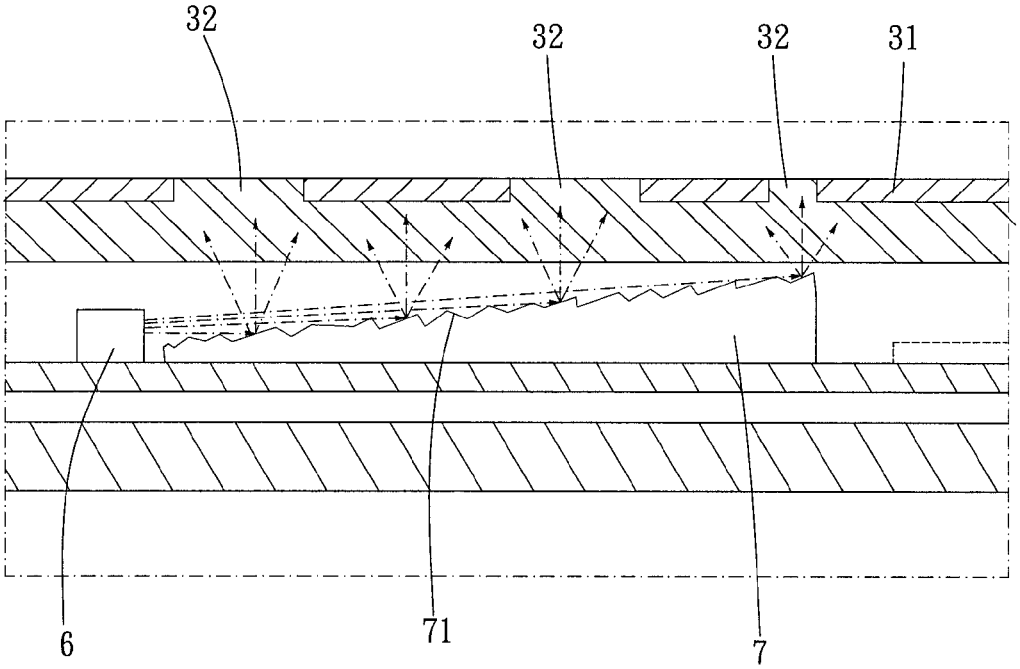
FIG. 4 is a partially-enlarged view of FIG. 3.
Figure 5:
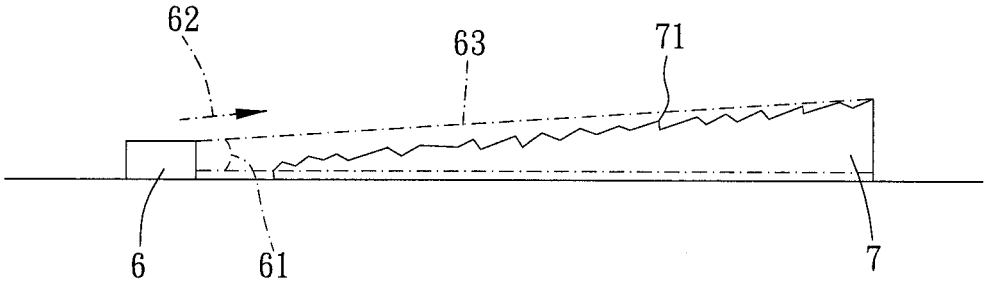
FIG. 5 is an enlarged view of a light-emitting portion and a scattering light-guiding portion of the preferred embodiment of the present invention in use.
Figure 6:
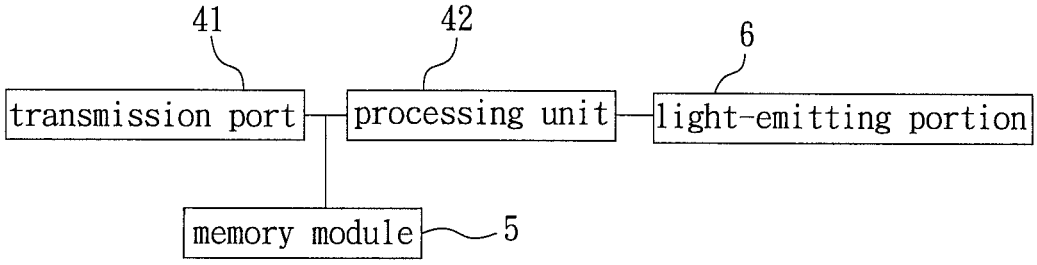
FIG. 6 is a diagram showing a structural relationship of the preferred embodiment of the present invention.

Please refer to FIGS. 1 to 6 for a first embodiment of the present invention. A solid state disk 1 includes a main body 2, at least one light-emitting portion 6 and at least one scattering light-guiding portion 7.

The main body 2 includes a shell portion 3, a substrate 4 which is disposed on the shell portion 3 and a memory module 5 which is disposed on the substrate 4, the substrate 4 includes a transmission port 41, the memory module 5 is electrically connected to the transmission port 41, and more specifically, the transmission portion 41 can transmit not only electricity but also data. The at least one light-emitting portion 6 is disposed on the substrate 4 and electrically connected to the transmission port 41. The at least one scattering light-guiding portion 7 is arranged on the substrate 4 correspondingly to the at least one light-emitting portion 6 without covering any part of the at least one light-emitting portion 6, each said scattering light-guiding portion 7 has a scattering structure 71, and at least one part of light emitted from each said light-emitting portion 6 projects toward the scattering structure 71 and is scattered evenly via the scattering light-guiding portion 7 to an exterior of the solid state disk 1. Therefore, the scattering light-guiding portion 7 does not influence a heat-dissipating effect of the light-emitting portion 6, and the light-emitting portion 6 and the scattering light-guiding portion 7 have a fixed distance therebetween so that the scattering light-guiding portion 7 can scatter the light evenly.

In this embodiment, the at least one light-emitting portion 6 has a light-emitting angle 61, the light emitted from the at least one light-emitting portion 6 has a projecting direction 62 and a lightened area 63, and along the projecting direction 62, the lightened area 63 is not beyond the scattering structure 71 so as to elevate a utilization rate of power. The scattering structure 71 is a rugged structure which is capable of total reflection and located on an exterior surface of the scattering light-guiding portion 7 so that the evenness and brightness of the light scattered can be maintained, and the solid state disk 1 has a preferable visual effect. The shell portion 3 has at least one light-penetrable portion 30, and the at least one light-penetrable portion 30 corresponds to the scattering structure 71 so that the light can be projected to the exterior of the solid state disk 1 through the light-penetrable portion 30. The light-penetrable portion 30 includes at least one decoration plate 31 on the shell portion 3 and a light-penetrable pattern portion 32 (for example, a trademark) disposed on the decoration plate 31, and the light-penetrable pattern portion 32 can add beauty to the solid state disk 1. Preferably, the light-penetrable portion 32 is not hollow-out and is layer made of a transparent material (for example, but not limited to, a transparent glass) so as to prevent dust from entering an interior of the solid state disk 1.

Each said scattering light-guiding portion 7 is disposed on the substrate 4 and neighboring to at least one said light-emitting portion 6, and the at least one scattering light-guiding portion 7 is tiltedly arranged correspondingly to the at least one light-emitting portion 6. When the light-penetrable portion 30 has a greater area, the lights reflected by portions from an end to an opposite end of the scattering light-guiding portion 1 have different brightness. When seeing the solid state disk 1 from outside, the light-penetrable pattern portion 32 will show a gradient light effect. The light-penetrable portion 30 is tilted relative to the scattering light-guiding portion 7, and a tilting angle can be adjusted according to the brightness or light configurations needed. Preferably, the at least one light-emitting portion 6 is selectively emittable in any of at least two kinds of light in different colors, so when the solid state disk 1 is used, there will be more color variations and unique visual effects. The substrate 4 is further provided with a processing unit 42, the processing unit 42 is electrically connected to the at least one light-emitting portion 6, the at least one light-emitting portion 6 is controllable by the processing unit 42, and the processing unit 42 can control the light-emitting portion 6 to emit light in accordance with the operation states of the solid state disk 1.

In other embodiments, the scattering structure may be a scattering net point structure; along the projecting direction of the light-emitting portion, the lightened area may be beyond the scattering structure; the scattering structure may be incapable of total reflection, and the scattering structure may be not disposed on the exterior surface, but for example (but not limited thereto) in a light-penetrable or transparent material; the shell portion may not include the decoration plate, the shell portion may be directly provided with the light-penetrable pattern portion, or the shell portion and the decoration plate may be integrally formed; the light-penetrable pattern portion of the solid state disk may be a hollow-out structure; the at least one scattering light-guiding portion may be arranged relative to the at least one light-emitting portion in parallel as long as the scattering structure can reflect the light to the light-penetrable portion; the light-penetrable portion is relatively parallel to the scattering light-guiding portion, for example (but not limited thereto), the light-penetrable portion has the same tilting angle as the scattering light-guiding portion does; the substrate may further include other device units, for example (but not limited thereto), a special device like a transmission speed detection unit to increase the functionality of the solid state disk; and the light-emitting portion may emit the light in only one color.

Given the above, the light-emitting portion of the solid state disk can dissipate heat smoothly, the light-emitting portion has greater utilization rate of power, the light-emitting portion and the scattering light-guiding portion are configured in the way that the solid state disk can present an even and unique visual effect.

While we have shown and described various embodiments in accordance with the present invention, it should be clear to those skilled in the art that further embodiments may be made without departing from the scope of the present invention.

What is claimed is:

1. A solid state disk, including:

a main body, including a shell portion, a substrate which is disposed on the shell portion and a memory module which is disposed on the substrate, the substrate including a transmission port, the memory module being electrically connected to the transmission port;

at least one light-emitting portion, disposed on the substrate and electrically connected to the transmission port;

at least one scattering light-guiding portion, arranged on the substrate correspondingly to the at least one light-emitting portion without covering any part of the at least one light-emitting portion, each said scattering light-guiding portion having a scattering structure, at least one part of light emitted from each said light-emitting portion projecting toward the scattering structure and being scattered evenly via the scattering light-guiding portion to an exterior of the solid state disk.

2. The solid state disk of claim 1, wherein the at least one light-emitting portion has a light-emitting angle, the light emitted from the at least one light-emitting portion has a projecting direction and a lightened area, and along the projecting direction, the lightened area is not beyond the scattering structure.

3. The solid state disk of claim 1, wherein the scattering structure is a rugged structure or a scattering net point structure.

4. The solid state disk of claim 1, wherein the shell portion has at least one light-penetrable portion, and the at least one light-penetrable portion corresponds to the scattering structure.

5. The solid state disk of claim 4, wherein the at least one light-penetrable portion includes a decoration plate on the shell portion and a light-penetrable pattern portion disposed on the decoration plate.

6. The solid state disk of claim 1, wherein each said scattering light-guiding portion is disposed on the substrate and neighboring to at least one said light-emitting portion.

7. The solid state disk of claim 1, wherein the at least one scattering light-guiding portion is tiltedly arranged correspondingly to the at least one light-emitting portion.

8. The solid state disk of claim 1, wherein the at least one light-emitting portion is selectively emittable in any of at least two kinds of light in different colors.

9. The solid state disk of claim 1, wherein the substrate is further provided with a processing unit, the processing unit is electrically connected to the at least one light-emitting portion, and the at least one light-emitting portion is controllable by the processing unit.

10. The solid state disk of claim 1, wherein the at least one light-emitting portion has a light-emitting angle, the light emitted from the at least one light-emitting portion has a projecting direction and a lightened area, and along the projecting direction, the lightened area is not beyond the scattering structure; the scattering structure is a rugged structure which is capable of total reflection and located on an exterior surface of the scattering light-guiding portion; the shell portion has at least one light-penetrable portion, and the at least one light-penetrable portion corresponds to the scattering structure; the light-penetrable portion includes a decoration plate on the shell portion and a light-penetrable pattern portion disposed on the decoration plate; each said scattering light-guiding portion is disposed on the substrate and neighboring to at least one said light-emitting portion; the at least one scattering light-guiding portion is tiltedly arranged correspondingly to the at least one light-emitting portion, and the light-penetrable portion is tilted relative to the scattering light-guiding portion; the at least one light-emitting portion is selectively emittable in any of at least two kinds of light in different colors; the substrate is further provided with a processing unit, the processing unit is electrically connected to the at least one light-emitting portion, the at least one light-emitting portion is controllable by the processing unit.

* * * * *